US007477116B2

(12) United States Patent
du Toit et al.

(10) Patent No.: US 7,477,116 B2
(45) Date of Patent: Jan. 13, 2009

(54) PHASE SHIFTERS HAVING A TUNABLE DIELECTRIC LAYER AND A RESISTIVE INK LAYER AND METHOD OF MANUFACTURE THEREFORE

(75) Inventors: Cornelis Frederick du Toit, Ellicott City, MD (US); Louise C. Sengupta, Ellicott City, MD (US)

(73) Assignee: Paratek Microwave, Inc., Columbia, MO (US)

( * ) Notice: Subject to any disclaimer, the term of this patent is extended or adjusted under 35 U.S.C. 154(b) by 0 days.

(21) Appl. No.: 11/698,547

(22) Filed: Jan. 27, 2007

(65) Prior Publication Data

US 2007/0200649 A1 Aug. 30, 2007

Related U.S. Application Data

(62) Division of application No. 11/178,099, filed on Jul. 8, 2005, now abandoned.

(60) Provisional application No. 60/586,266, filed on Jul. 8, 2004.

(51) Int. Cl.
*H01P 1/18* (2006.01)

(52) U.S. Cl. ..... 333/161; 333/156

(58) Field of Classification Search ..... 333/156, 333/161

See application file for complete search history.

(56) References Cited

U.S. PATENT DOCUMENTS

| | | | | |
|---|---|---|---|---|
| 5,472,935 | A * | 12/1995 | Yandrofski et al. | 505/210 |
| 7,048,992 | B2 * | 5/2006 | Zhang et al. | 428/209 |
| 7,123,115 | B2 * | 10/2006 | du Toit | 333/161 |
| 2002/0014932 | A1 * | 2/2002 | Osadchy et al. | 333/161 |

* cited by examiner

*Primary Examiner*—Benny Lee
(74) *Attorney, Agent, or Firm*—James S. Finn, Esq.

(57) ABSTRACT

An embodiment of the present invention provides a phase shifter, comprising a substrate, resistive ink adjacent one surface of said substrate and separating a voltage tunable dielectric material from said surface of said substrate and a plurality of conductors adjacent said voltage tunable dielectric material separated so as to form a gap filled with resistive ink in said gap.

4 Claims, 7 Drawing Sheets

PHASE SHIFTERS HAVING A TUNABLE DIELECTRIC LAYER AND A RESISTIVE INK LAYER AND METHOD OF MANUFACTURE THEREFORE

CROSS REFERENCE TO RELATED APPLICATIONS

This application is a divisional application of U.S. patent application Ser. No. 11/178,099 entitled PHASE SHIFTERS AND METHOD OF MANUFACTURE THEREFORE by Cornelis Frederick du Toit, filed on Jul. 8, 2005 (abandoned), which claimed the benefit of Provisional Patent Application Ser. No. 60/586,266, filed Jul. 08, 2004 entitled "Ka-Band Phase Shifter Technology Based on Parascan® Tunable Materials".

BACKGROUND OF THE INVENTION

At frequencies such as Ka band frequencies, voltage tunable dielectric phase shifters are usually designed around the concept of a tunable transmission line section, where the propagation velocity of the dielectric material is tuned to create a variable propagation delay through the transmission line section. These designs typically have a wide bandwidth of operation (>20%). They also exhibit high power capabilities (>1 W) and very linear behavior (low intermodulation distortion), since the circuit has an electrically large area that can distribute RF thermal heating effects over a large area, and due to the lack of resonant structures, peak RF voltages and currents are reduced.

However, decreasing size and increasing performance and tunability are always important due to increasing demands of wireless communications. Thus, a strong need exists for improved phase shifters and methods of manufacture therefore.

SUMMARY OF THE INVENTION

An embodiment of the present invention provides a hybrid phase shifter, comprising a first port wherein a microwave signal enters the hybrid phase shifter and splits and exits from two other ports into two reflector circuits, wherein the microwave signal reflects and re-enters the hybrid phase shifter and recombines and exits at an isolated port. The phase shifter may be operable at frequencies between 0.9 GHz and 5 GHz and operable at frequencies in the Ka-band. An embodiment of the present invention provides the hybrid phase shifter may further comprise meandering microstrip lines or using non-uniform lines such as alternating narrow and wide sections thereby enabling an overall size reduction a factor of 1.5 to 2. The meandering strip lines may be formed on a substrate and the phase shifter may be made tunable using voltage tunable dielectric material with the phase shifter.

Another embodiment of the present invention provides a phase shifter, comprising a substrate, resistive ink adjacent one surface of the substrate and separating a voltage tunable dielectric material from the surface of said substrate; and a plurality of conductors adjacent the voltage tunable dielectric material separated so as to form a gap filled with resistive ink in the gap. This embodiment may further comprise a voltage source connected to at least one of the plurality of conductors and connected to the resistive ink separating the substrate and the voltage tunable dielectric material.

Yet another embodiment of the present invention provides a method of phase shifting a microwave signal, comprising entering a hybrid phase shifter via a first port by a microwave signal and splitting and exiting from two other ports into two reflector circuits, wherein the microwave signal reflects and re-enters said hybrid phase shifter and recombines and exits at an isolated port. In an embodiment of this method meandering strip lines may be formed on a substrate and wherein the phase shifter may be made tunable using voltage tunable dielectric material with the phase shifter.

Yet another embodiment of the present invention provides for a method of manufacturing a phase shifter, comprising providing a substrate, placing resistive ink adjacent one surface of the substrate and between a voltage tunable dielectric material and the substrate and placing a plurality of conductors adjacent the voltage tunable dielectric material separated so as to form a gap filled with resistive ink in said gap. An embodiment of this method may further comprise connecting a voltage source to at least one of said plurality of conductors and to the resistive ink separating the substrate and the voltage tunable dielectric material.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

Figure 1:
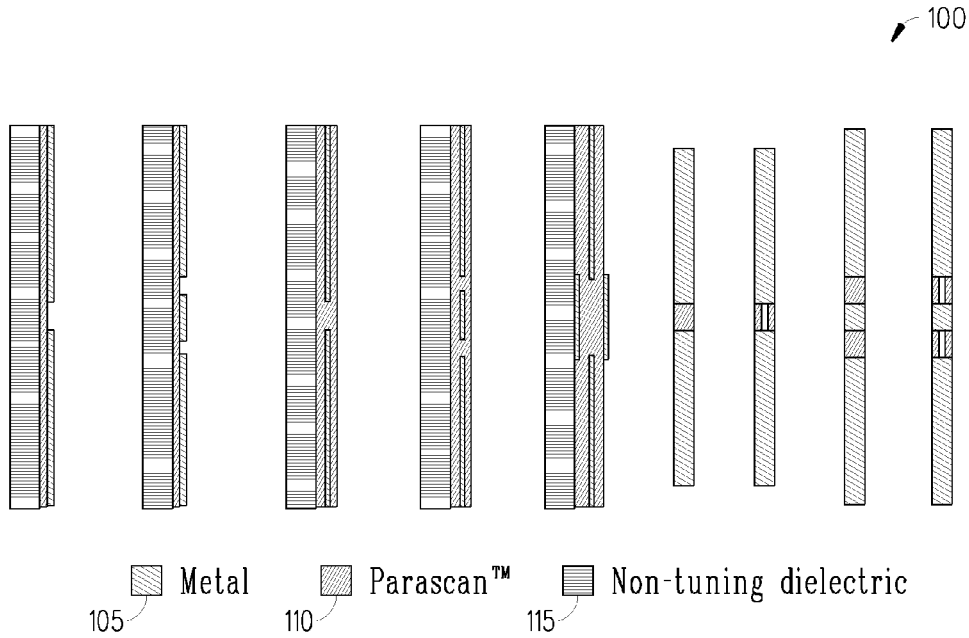
FIG. 1 illustrates several phase shifter transmission line/variable capacitor gap cross-sections of one embodiment of the present invention.

An embodiment of the present invention provides a low loss, low bias voltage, small footprint phase shifter which may be, although is not required to be, between 18 and 46 GHz. This embodiment may comprise a low loss optimized cross-section topology with material described below and optimized for low bias voltage.

Extra dielectric loading and meandering or non-uniform transmission line techniques may be used to reduce the size of the 180° hybrid type phase shifters. The 180° hybrid versus a lumped element all-pass network phase shifter type may be down-selected based on overall performance for production.

At Ka band frequencies, tunable dielectric phase shifters are usually designed around the concept of a tunable transmission line section, where the propagation velocity of the tunable dielectric material is tuned to create a variable propagation delay through the transmission line section. These designs typically have a wide bandwidth of operation (>20%). They also exhibit high power capabilities (>1 W) and very linear behavior (low intermodulation distortion), since the circuit has an electrically large area that can distribute RF thermal heating effects over a large area, and due to the lack of resonant structures, peak RF voltages and currents are reduced.

For low power (<1 W) phase shifters, a 180° hybrid with reflector circuits are used, or a lumped element approach is used, since these circuits are electrically much smaller than the transmission line type. At the heart of these designs are lumped element voltage tunable capacitors based on tunable dielectric materials. The main disadvantages of these circuits, compared to the transmission line approach, are low power handling capability and a narrow bandwidth (<10%) of operation. If a compact size, narrow band and low RF power (0.1 W) is required, a lumped element or 180° hybrid with reflector circuit may be used.

Both the transmission line type phase shifter's and the lumped element tunable capacitor's performance are governed by their geometry. Several cross-sectional topologies have been pursued based on 3 basic material configurations. These material configurations are:

1. Bulk material. In this configuration, a relatively thick (>100 μm) substrate is used as part of the guided wave structure to form a phase shifter. Typical Ka-band applications include the use of bulk tunable material to load a parallel plate capacitor, to load a waveguide, or to use it as substrates for microstrip, stripline or coplanar waveguide, or to use it simply as an RF lens. Due to the relative thickness, the required bias voltage tends to be very high, depending on the thickness, but it is able to handle very high power RF signals (several hundred Watts).
2. Thick film material. In this configuration, the material is used as a thin layer, between 1.5 μm and 100 μm thick. Typical Ka-band applications include configurations where a narrow metallization gap is bridged by a thick film layer of tunable material, such as the gap in a capacitor, a slotline, finline, or a coplanar waveguide. These configurations are capable of handling high RF power signals (tens of Watts). The bias voltage requirement is typical in the order of a few hundred volts. Transverse biasing with the aid of resistive inks are one way of reducing the biasing voltage, discussed in more detail below.
3. Thin film material. This material configuration is used as very thin (<1.5 μm) layers and can be used in the same way as the thick film material, i.e. bridging narrow metallization gaps. It has similar to slightly lower power handling capability than thick film configurations, and the required bias voltage typically between 50V and 150V, depending on the biasing gap width.

There exists several parameter trade-offs that need to be considered in a typical phase shifter design. The tunability of the material, the loss tangent, i.e., tan δ, of the material, and the topology used to guide the electromagnetic wave are the three main variables. These trade-offs influence the final size and insertion loss of the phase shifters. Material tunability t is defined as $$t = 1 - \frac{\varepsilon_{r(\min)}}{\varepsilon_{r(\max)}}, \tag{1}$$

where $\in_{r(min)}$ and $\in_{r(max)}$ are respectively the minimum and maximum relative permittivity of the material. The loss tangent of the material is defined as:

$$\tan\delta = \frac{1}{Q}, \tag{2}$$

where Q is the quality factor of the material, i.e. the ratio of stored to dissipated electromagnetic energy in the material. A material figure of merit $FOM_{mat}$, which is convenient to use with regards to phase shifter applications, is defined as the amount of material loss contribution in dB of a 360° transmission line-type phase shifter:

$$FOM_{mat} = \frac{20\pi}{\ln(10)} \frac{\tan\delta}{\left(1 - \sqrt{1-t}\right)} \text{dB}. \tag{3}$$

The phase shifter performance is similarly described in terms of the device figure of merit:

$$FOM_{dev} = \frac{\text{Measured_loss}_{[\text{dB}]}}{\text{Measured_total_phase_shift}_{[°]}} 360°. \tag{4}$$

The device figure of merit $FOM_{dev}$ incorporates not only material losses, but also conductor and matching losses and are the measure loss of the device (Measured_loss) divided by Measured_total phase shift of the device.

The gap topology of both the variable capacitor and variable transmission line section is defined by their cross-sections. Examples of cross-sections that have been investigated as shown generally as 100 of FIG. 1 with metal 105, voltage tunable dielectric (such as Parascan® tunable dielectric material) 110 and non-tuning dielectric 115.

Figure 2:
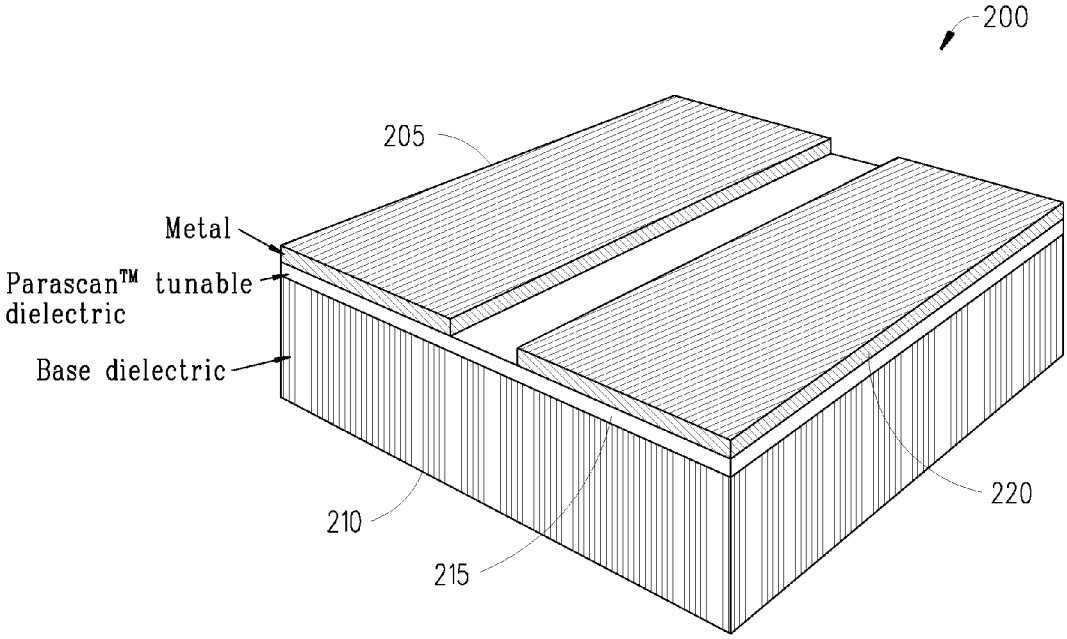
FIG. 2 illustrates a basic tunable capacitor gap with tunable dielectric loading of one embodiment of the present invention.

FIG. 2 illustrates at 200 a basic tunable capacitor gap with tunable dielectric loading. The tunable capacitor of FIG. 2 includes metal electrodes 205 and 220, base dielectric 210 and tunable dielectric 215. All of these topologies can be packaged in different configurations, such as in an open structure on other supporting substrates, or it may be packaged inside a metal waveguide or cavity.

Figure 3:
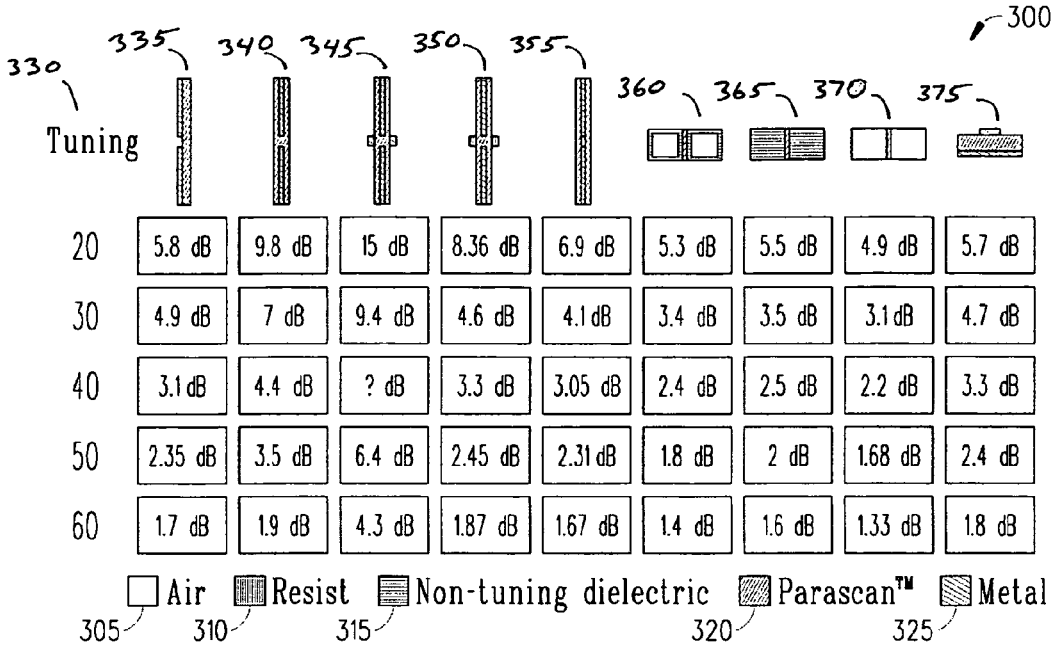
FIG. 3 shows how a uniform transmission line configuration is tabulated as a function of tuning and cross-section topology of a uniform transmission line phase shifter for material tan δ 0.02. of one embodiment of the present invention.

Turning now to FIG. 3 are cross-section topologies with different performance characteristics in uniform transmission line configurations shown as 335, 340, 345, 350, 355, 360, 365, 370 and 375, including: air 305, resist 310, non-tuning dielectric 315, Parascan tunable dielectric 320 and metal 325. The horizontal axis provides cross-section topology for a given material tan δ and the vertical axis provides tunability 330 in increments of 10 of 20-60. Although the operation of a variable capacitor is fundamentally different from a transmission line with the same gap- cross-section, these results do provide some additional insight. In the tunable capacitor case, very little currents flow parallel to the gap, but in the transmission line case, losses are amplified by propagating currents flowing parallel with the gap. The $FOM_{dev}$ a uniform transmission line configuration is tabulated as a function of tunability and cross-section topology for a given material tan δ. For tunability 330 of 20 for the configuration shown as 335 the performance characteristic is 5.8 dB; for tunability 330 of 30 for the configuration shown as 335 the performance characteristic is 4.9 dB; for tunability 330 of 40 for the configuration shown as 335 the performance characteristic is 3.1 dB; for tunability 330 of 50 for the configuration shown as 335 the performance characteristic is 2.35 dB; for tunability 330 of 60 for the configuration shown as 335 the performance characteristic is 1.7 dB; for tunability 330 of 20 for the configuration shown as 340 the performance characteristic is 9.8 dB; for tunability 330 of 30 for the configuration shown as 340 the performance characteristic is 7.0 dB; for tunability 330 of 40 for the configuration shown as 340 the performance characteristic is 4.4 dB; for tunability 330 of 50 for the configuration shown as 340 the performance characteristic is 3.5 dB; for tunability 330 of 60 for the configuration shown as 340 the performance characteristic is 1.9 dB; for tunability 330 of 20 for the configuration shown as 345 the performance characteristic is 15 dB; for tunability 330 of 30 for the configuration shown as 345 the performance characteristic is 9.4 dB; for tunability 330 of 40 for the configuration shown as 345 the performance characteristic is ?dB; for tunability 330 of 50 for the configuration shown as 345 the performance characteristic is 6.4 dB; for tunability 330 of 60 for the configuration shown as 345 the performance characteristic is 4.3 dB; for tunability 330 of 20 for the configuration shown as 350 the performance characteristic is 8.36 dB; for tunability 330 of 30 for the configuration shown as 350 the performance characteristic is 4.6 dB; for tunability 330 of 40 for the configuration shown as 350 the performance characteristic is 3.3 dB; for tunability 330 of 50 for the configuration shown as 350 the performance characteristic is 2.45 dB; for tunability 330 of 60 for the configuration shown as 350 the performance characteristic is 1.87 dB; for tunability 330 of 20 for the configuration shown as 355 the performance characteristic is 6.9 dB; for tunability 330 of 30 for the configuration shown as 355 the performance characteristic is 4.1 dB; for tunability 330 of 40 for the configuration shown as 355 the performance characteristic is 3.05 dB; for tunability 330 of 50 for the configuration shown as 355 the performance characteristic is 2.31 dB; for tunability 330 of 60 for the configuration shown as 355 the performance characteristic is 1.67 dB; for tunability 330 of 20 for the configuration shown as 360 the performance characteristic is 5.3 dB; for tunability 330 of 30 for the configuration shown as 360 the performance characteristic is 3.4 dB; for tunability 330 of 40 for the configuration shown as 360 the performance characteristic is 2.4 dB; for tunability 330 of 50 for the configuration shown as 360 the performance characteristic is 1.8 dB; for tunability 330 of 60 for the configuration shown as 360 the performance characteristic is 1.4 dB; for tunability 330 of 20 for the configuration shown as 365 the performance characteristic is 5.5 dB; for tunability 330 of 30 for the configuration shown as 365 the performance characteristic is 3.5 dB; for tunability 330 of 40 for the configuration shown as 365 the performance characteristic is 2.5 dB; for tunability 330 of 50 for the configuration shown as 365 the performance characteristic is 2.0 dB; for tunability 330 of 60 for the configuration shown as 365 the performance characteristic is 1.6 dB; for tunability 330 of 20 for the configuration shown as 370 the performance characteristic is 4.9 dB; for tunability 330 of 30 for the configuration shown as 370 the performance characteristic is 3.1 dB; for tunability 330 of 40 for the configuration shown as 370 the performance characteristic is 2.2 dB; for tunability 330 of 50 for the configuration shown as 370 the performance characteristic is 1.68 dB; for tunability 330 of 60 for the configuration shown as 370 the performance characteristic is 1.33 dB; for tunability 330 of 20 for the configuration shown as 375 the performance characteristic is 5.7 dB; for tunability 330 of 30 for the configuration shown as 375 the performance characteristic is 4.7 dB; for tunability 330 of 40 for the configuration shown as 375 the performance characteristic is 3.3 dB for tunability 330 of 50 for the configuration shown as 375 the performance characteristic is 2.4 dB; for tunability 330 of 60 for the configuration shown as 375 the performance characteristic is 1.8 dB.

The "resist" layers are thin resistive layers, which are used to apply bias voltage, but are chosen with high enough resistivity so that it is essentially invisible at the RF frequencies. It is clear from the table of FIG. 3 that the cross-section topology has a significant influence on the final transmission line phase shifter performance. The topology essentially determines the amount of conductor loss contribution. Therefore, once the most appropriate material has been selected, the design may then be further optimized only in terms of the topology and its dimensional parameters.

Figure 4:
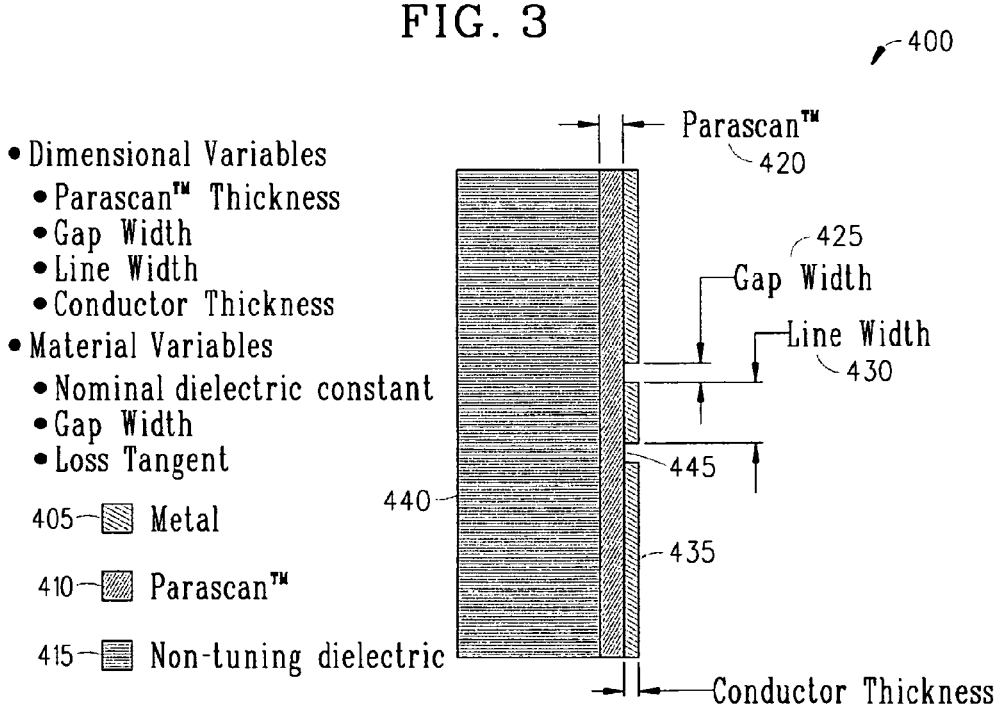
FIG. 4 shows Design parameters of a CPW phase shifter cross-section of one embodiment of the present invention.

The trade-offs between the different design parameters of a given cross-section will be described here in more detail, based on the co-planar waveguide (CPW) cross-section topology. A variable capacitor can be based on this cross-section by using the central strip as a convenient biasing electrode, turning it into two capacitors in series. Thus, most of the results for the CPW investigation will be relevant, except where noted otherwise. For this topology, the design parameters are defined in FIG. 4 and include: Parascan tunable dielectric 420, gap width 425, line width 430, conductor thickness 435 and substrate thickness 440, with placement of the conductor on substrate shown at 445. Metal material is shown as 405, tunable dielectric 410 and non-tuning dielectric 415. The cross-section topology determines the amount of conductor loss contribution, as well as the required biasing voltage needed for tuning the material. As depicted in the legend of FIG. 4 the dimensional variables may include Parascan® thickness, gap width, line width and conductor thickness. Material variables may include nominal dielectric constant, tunability and loss tangent.

Figure 5:
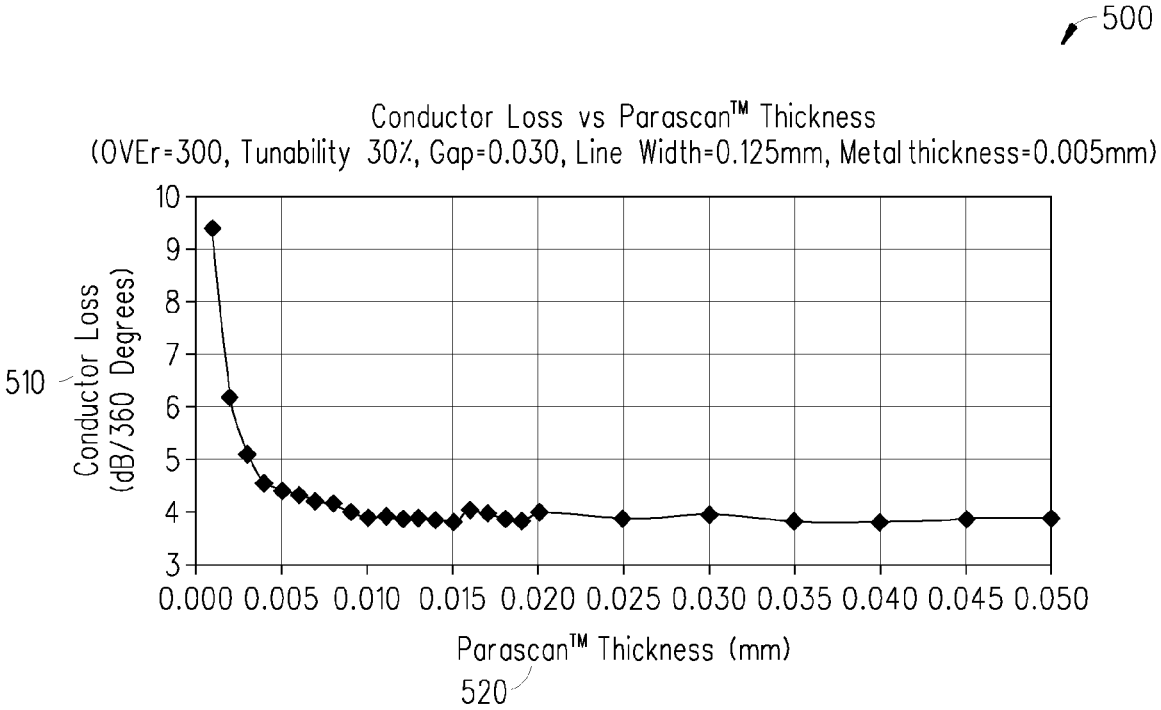
FIG. 5 is a graph of conductor loss vs. tunable dielectric thickness.

The conductor loss contribution as a function of some of the most important design parameters such as Parascan® thickness 520 vs conductor loss 510 are illustrated generally as 500 of FIG. 5.

A narrower gap in a CPW defines lower characteristic impedance, and hence the conductor currents will increase, causing higher losses. But larger gaps will require higher bias voltages; therefore there exist a trade-off between the lowest possible loss and the lowest possible biasing voltage. This trade-off essentially does not apply for capacitor performance, however, since it does not support propagating currents parallel to the gap, as mentioned earlier. Therefore, the effect of the gap width on the losses in a tunable capacitor is almost negligible.

The total conductor loss in a 360° CPW phase shifter as a function of the tunable dielectric material thickness is shown in FIG. 5. A thinner tunable material layer has less tunability per unit length, which therefore requires a longer phase shifter length or longer gap capacitors. This leads to more conductor loss for the same amount of tuning needed, in other words, a low tunable material thickness versus gap width ratio leads to more phase shifter loss.

Figure 6:
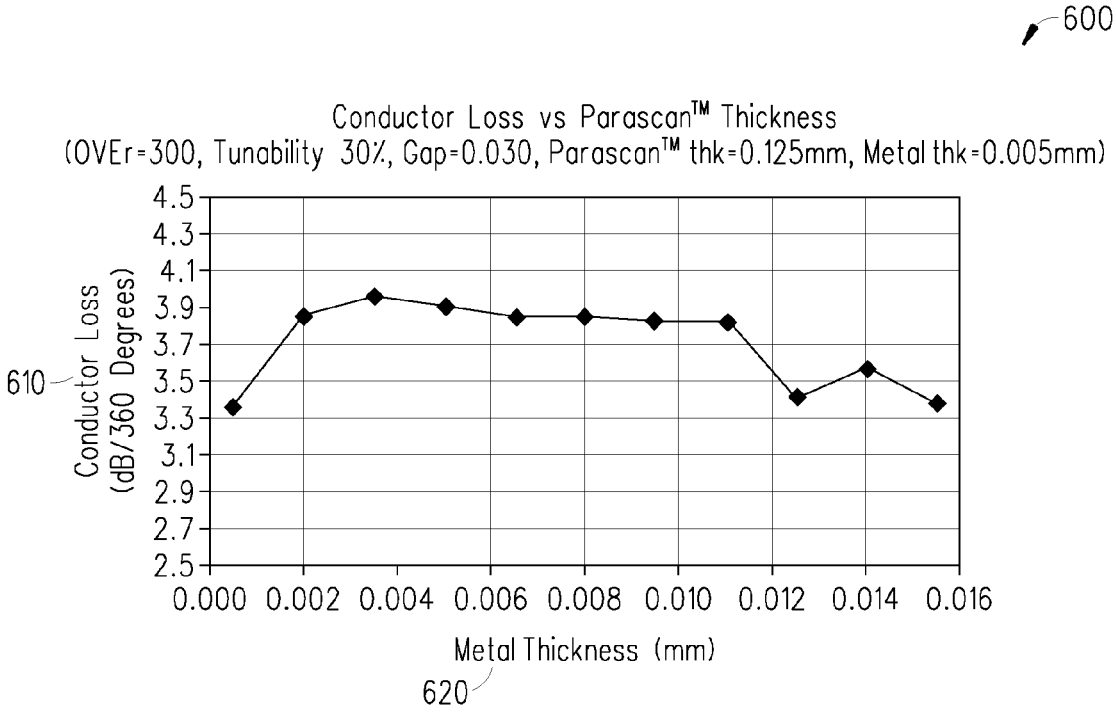
FIG. 6 is a graph of conductor loss vs. conductor thickness.

If the conductor currents are squeezed into a thinner conductor layer, we also expect higher losses, as shown in FIG. 6 at 600 which depicts conductor loss 610 vs. metal conductor thickness 620.

Figure 7:
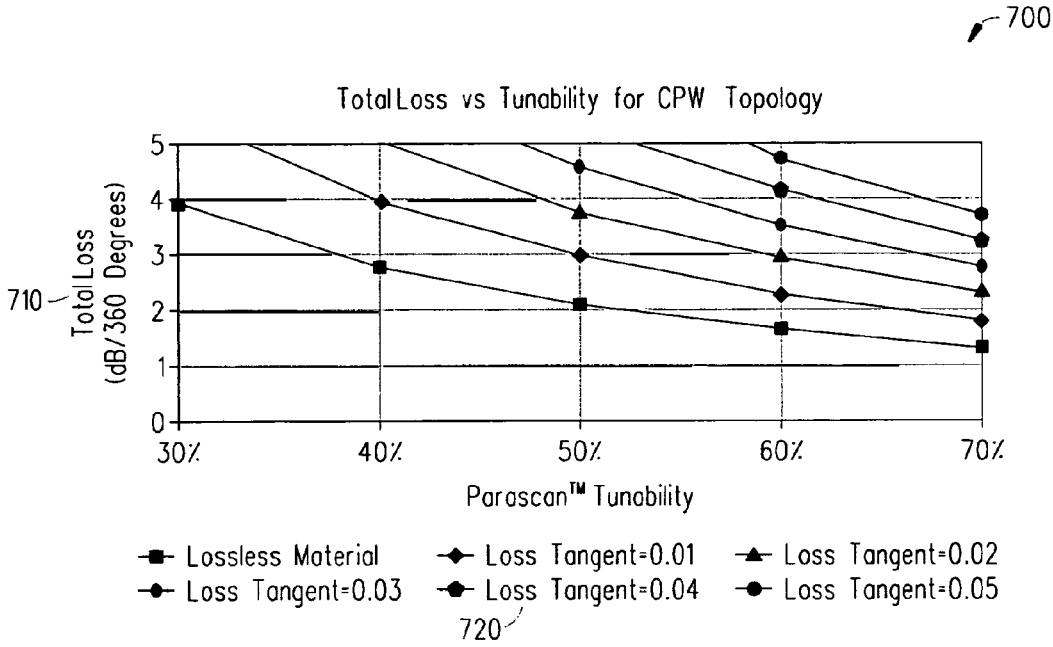
FIG. 7 is a graph of total loss versus tunability for CPW topology.

The total $FOM_{dev}$ is plotted in FIG. 7 as a function of the Parascan® tunability 720 for different loss tangents 710. Thus, FIG. 7 at 700 shows $FOM_{dev}$ is tabulated as a function of tuning and cross-section topology of a uniform transmission line phase shifter for material tan δ 0.02. In the case of a transmission line phase shifter, the length would have to be increased to make up for less tunability, while in a lumped element phase shifter, the capacitor gap lengths would have to be increased, or coupling into the lumped element resonators would have to be reduced. In all these cases, conductor loss will be increased.

The total phase shifter loss is also a function of frequency. If the phase shifter geometry is scaled in all dimensions with frequency, it is a well-known fact that the conductor loss should increase with the square root of the frequency. From experimental results we also know that the tunable material loss tend to increase in a similar non-linear manner with frequency.

An embodiment of the present invention provides lumped capacitor topologies supporting thick or thin film and provides methods for reducing bias voltage in tunable capacitors by concentrating on the gap cross-section geometry. One way of reducing the bias voltage, is to reduce of the gap dimension. Alternatively, biasing can be applied across the material layer using resistive layers invisible to the RF, while the gap is kept arbitrarily wide. Topologies favoring low bias voltage are provided below.

Reduced Gap Dimension

Figure 8:
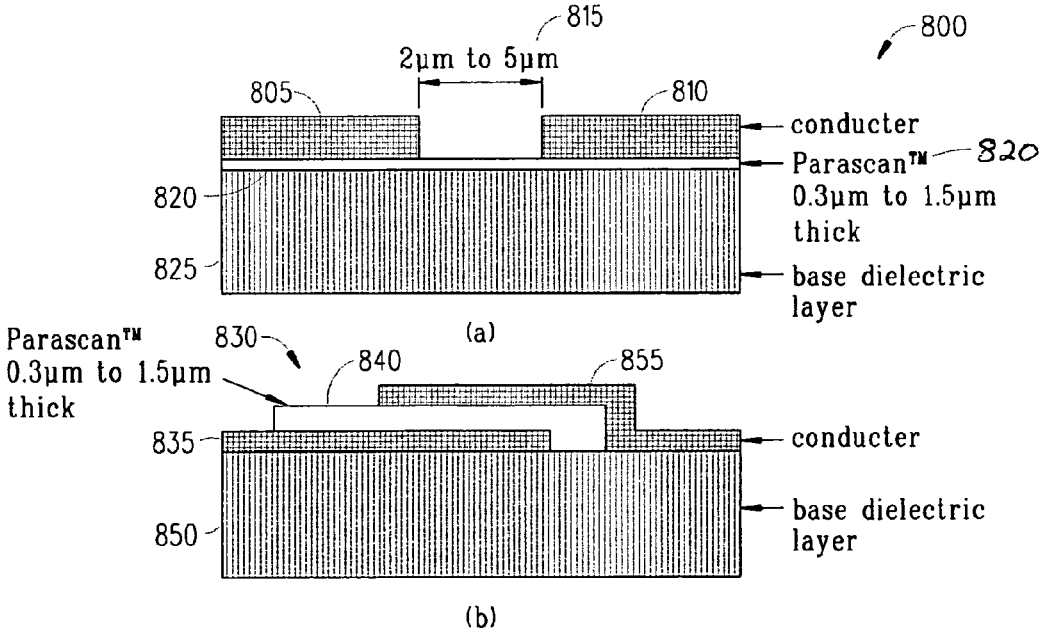
FIG. 8 illustrates two cross-section configurations (a) and (b) used in the low impedance sections of the loaded line phase shifter one embodiment of the present invention.

One way of reducing the gap is just to scale the coplanar dimensions, as shown in FIG. 8*a* at 800. A first embodiment comprises a base dielectric layer 825 adjacent to a Parascan® tunable dielectric layer 820 with two conductors 805 and 810 positioned above with a space in between to form a gap 815 which may be between 2 μm and 5 μm wide as illustrated by the text of FIG. 8. Further, the text of FIG. 8 provides verbiage concerning conductors 810 and a Parascan® thickness being between 0.3 μm and 1.5 μm in FIG. 8*a* and 3 μm and 2.0 in FIG. 8*b*. The text also provides conductors 855 of FIG. 8*b* and base dielectric layer 825 of FIG. 8*a* and 850 of FIG. 8*b*. Alternatively, as shown at 830, the conductor 855 on one side can be made to overlap with the opposite conductor 835, creating a biasing dimension equal to the Parascan® tunable material 840 thickness, as shown in FIG. 8*b* at 830. Both structures in FIGS. 8*a* and 8*b* are fairly simple, and the overlap technique allows for very high capacitance, compact structures. The disadvantages are that these structures have reduced power handling capability, and increased intermodulation distortion. The latter is due to the reduced biasing voltage being more comparable with the RF voltage, and the biasing and RF electric fields being coincident, which will cause the RF electric field to affect the dielectric properties of the material.

Wide-gap with Transverse Biasing

Figure 9:
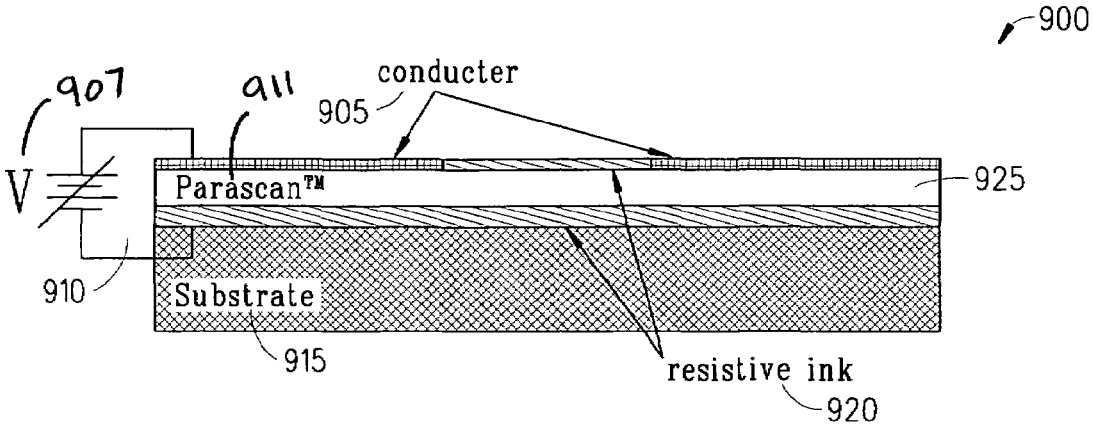
FIG. 9 illustrates a cross-section of a slotline with resistive ink biasing of one embodiment of the present invention.

The second method makes use of resistive inks to bias the tunable material directly through the thin dimension rather than across the gap. This configuration is shown in FIG. 9, generally shown as 900, with substrate 915, resistive ink 920, tunable dielectric 925, conductor 905 and voltage source 910. Since the tunable material thickness is typically several times smaller than the slotline gap, this method reduces the biasing voltage significantly. The gap can be kept arbitrarily wide, thereby preserving the low loss properties of a wide gap in transmission line structures, as well as reducing intermodulation distortion.

Cross-section Down-selection

The simplest capacitor gap cross-section from a manufacturing point of view is the coplanar gap. The overlapped conductor technique provides higher capacitance per area, and the transverse biasing technique with resistive inks has the advantage of higher power and lower intermodulation distortion. But these topologies are more complex from a manufacturing point of view, and the phase shifter specifications do not require high power (only 0.1 W) and very low intermodulation distortion (only −22 dBc), therefore the coplanar gap topology will be adequate.

Figure 10:
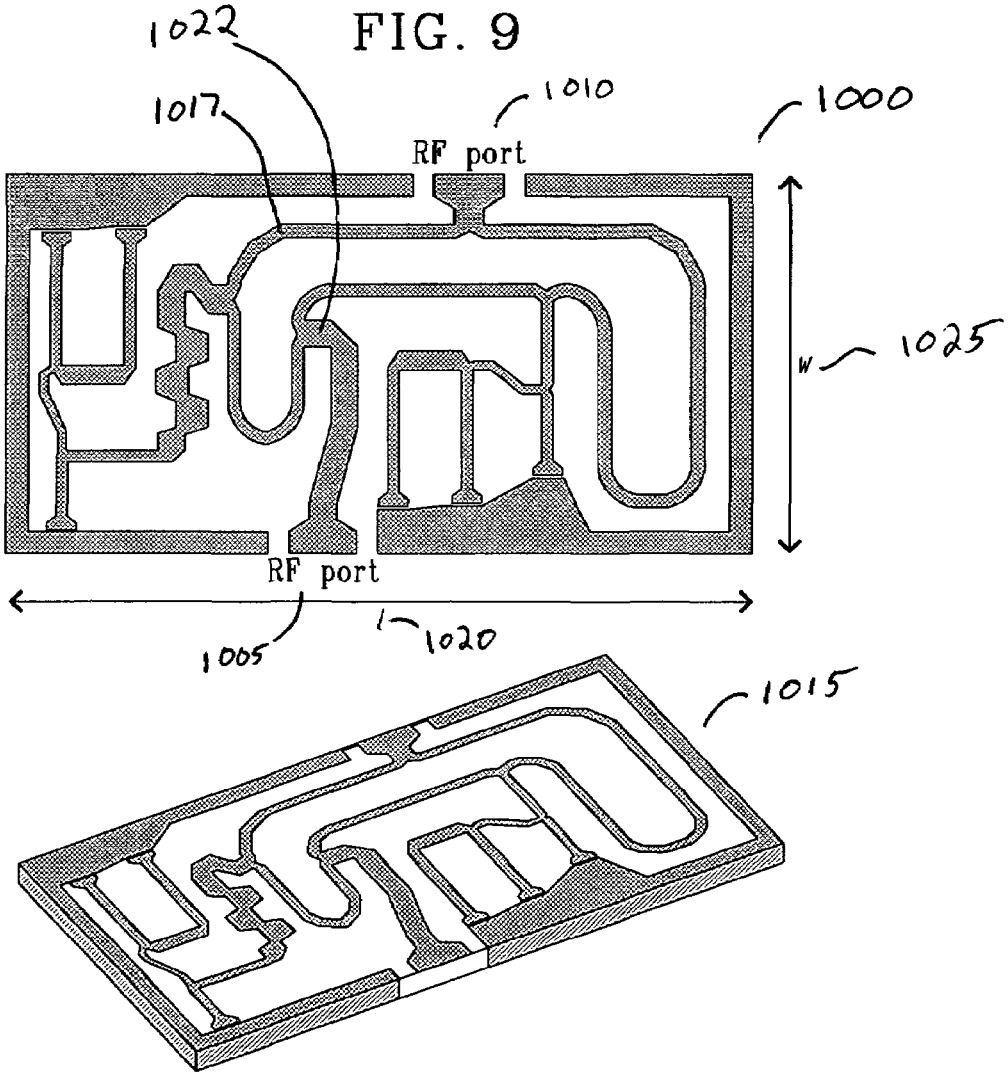
FIG. 10 illustrates a 180° hybrid phase shifter design layout of one embodiment of the present invention.

The basic Ka-band 180° hybrid phase shifter geometry is shown in FIG. 10 with a top view at 1000 and profile view 1015 and length 1 shown at 1020 and width w at 1025. Meandering lines are depicted at 1017 with varying thickness 1022. RF ports are depicted at 1010 and 1005. Microwave signals enter the hybrid at one port, split and exit from two other ports into the two reflector circuits, where it reflects, re-enter the hybrid, recombine and exit at the "isolated" port. Designs for this type of phase shifter has been built and tested, operating at frequencies between 0.9 GHz and 5 GHz. Designs for Ka-band frequencies have also been investigated and are essentially scaled versions of the same basic design. The phase shifter circuit shown in FIG. 10 requires external biasing, directly applied to the RF conductor. The circuit furthermore does not require any jumpers, and have slightly lower loss than the lumped element phase shifter described in the next section.

When printed on a 5 to 10 mil thick material with a dielectric constant of 10, current designs occupy an area 1×w=4.6 mm×2.9 mm at 19.9 GHz; 3.2 mm×2.0 mm at 29.4 GHz and 2.1 mm×1.3 mm at 44.5 GHz respectively. Size reduction to the required 1.7 mm×0.8 mm will be achievable through a combination of higher dielectric loading and meander line techniques. For example, a dielectric constant of 20 to 30 will reduce the dimensions by a factor 1.3 to 1.7. By meandering the microstrip lines or using non-uniform lines such as alternating narrow and wide sections, the overall size can reduced by another factor 1.5 to 2.

Figure 11:
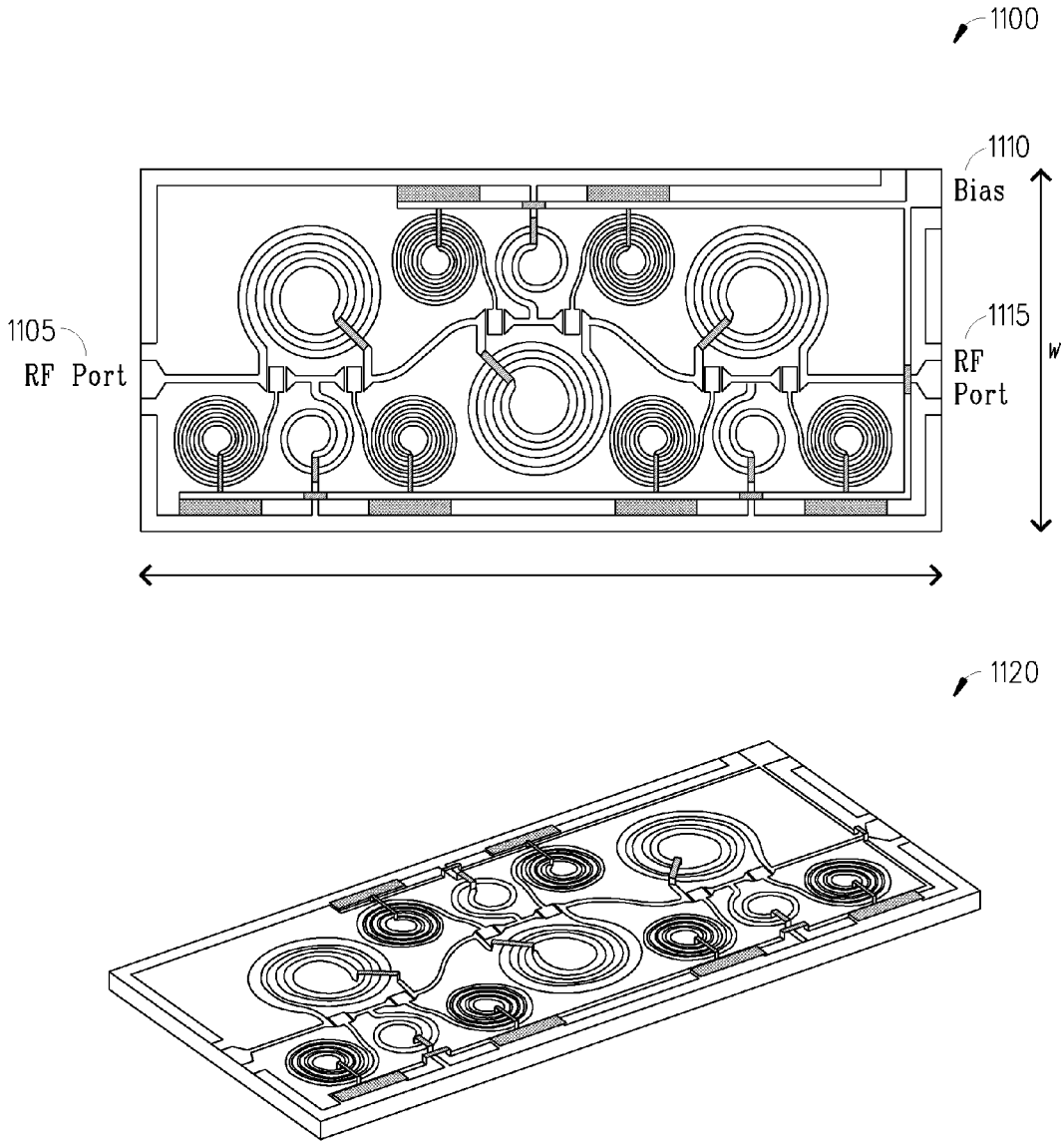
FIG. 11 illustrates an all-pass network phase shifter of one embodiment of the present invention and FIG. 12 illustrates three chip assemblies of three phase shifters of various embodiments of the present invention.

The second design to be considered here is based on an all-pass network principle. A combination of lumped capacitors and inductors form a circuit that can provide relative phase shift if the capacitors are tuned. The circuit layout is shown in FIG. 11 at 1100 with RF ports depicted at 1105 and 1115 and bias 1110. The profile view is shown at 1120. The circuit also has on-board RF chokes, so the bias voltage can be directly applied. Due to the limited space, the chokes have limited band width, and can therefore have an impact on the overall operational band width. Since the design is based on lumped elements, the size can be made to fit into the required 1×w=1.7 mm×0.8 mm area at all three design frequencies. The circuit does require jumpers, and lumped fixed capacitors, unlike the 180° hybrid circuit.

Figure 12:
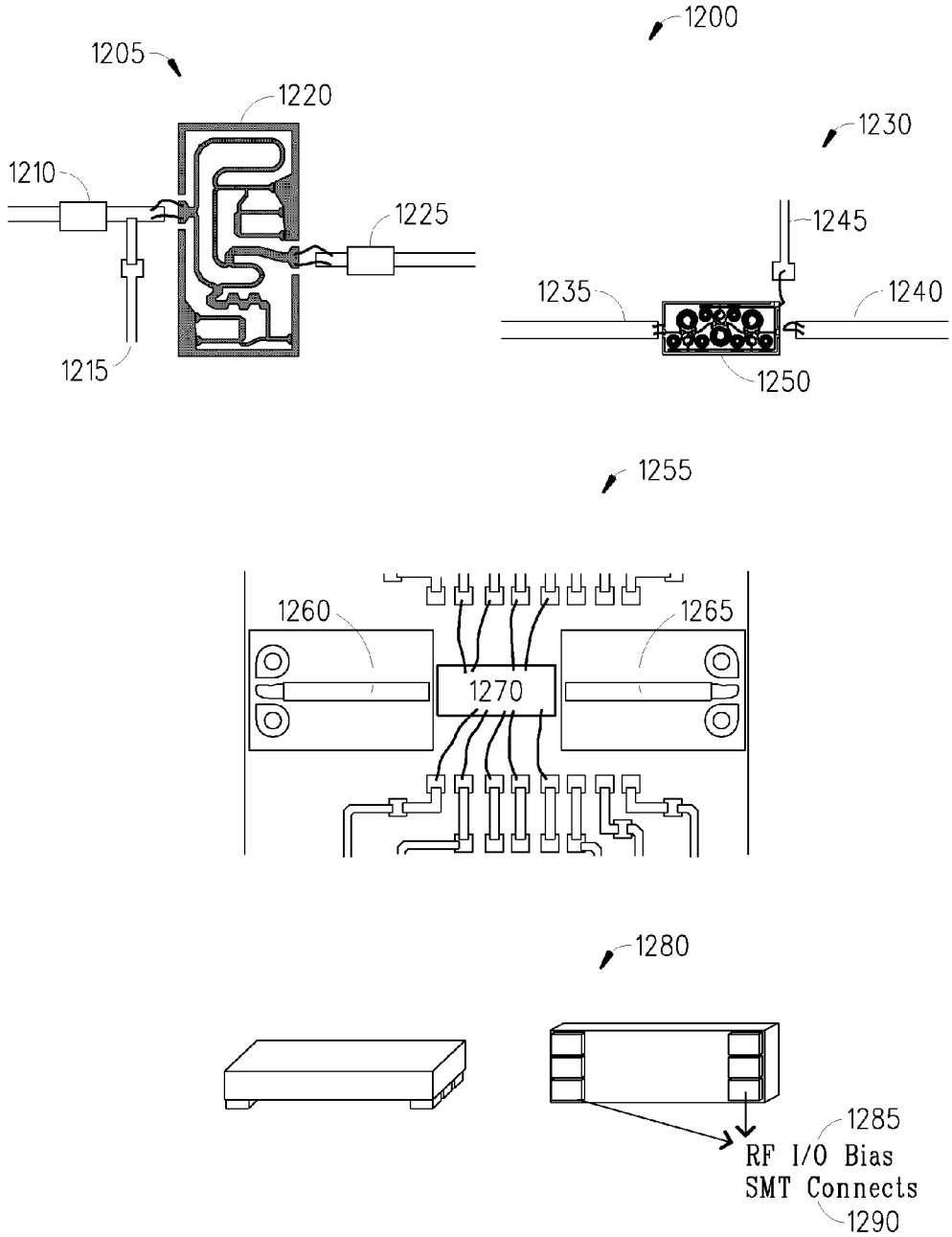

Turning now to FIG. 12 at 1200 are three chip assemblies of three phase shifters of various embodiments of the present invention. The chip assembly of hybrid phase shifter 1205 includes meandering lines 1220 with DC blocks 1210 and 1225 and bias line 1215. At 1230 is illustrated an all pass network lumped phase shifter 1230 with RF strips 1235 and 1240 and bias 1245 connected to circuit 1250. Depicted at 1255 is a chip assembly for a phase shifter with RF strips 1260 and 1265 connected to circuit 1270. Illustrated generally at 1280 is an SMT phase shifter mounting package of an embodiment of the present invention and may include RF I/O bias 1285 and SMT connects 1290.

The tunable dielectric capacitor in the present invention may be made from low loss tunable dielectric material. The range of Q factor of the tunable dielectric capacitor is between 50, for very high tuning material, and 300 or higher, for low tuning material. It also decreases with increasing the frequency, but even at higher frequencies, say 30 GHz, may take values as high as 100. A wide range of capacitance of the tunable dielectric capacitors is available, from several pF to several μF. The tunable dielectric capacitor may be a two-port component, in which the tunable dielectric material may be sandwiched between two specially shaped parallel electrodes. An applied voltage produces an electric field across the tunable dielectric, which produces an overall change in the capacitance of the tunable dielectric capacitor.

Tunable dielectric materials have been described in several patents. Barium strontium titanate (BaTiO.sub.3—SrTiO.sub.3), also referred to as BSTO, is used for its high dielectric constant (200-6,000) and large change in dielectric constant with applied voltage (25-75 percent with a field of 2 Volts/micron). Tunable dielectric materials including barium strontium titanate are disclosed in U.S. Pat. No. 5,427,988 by Sengupta, et al. entitled "Ceramic Ferroelectric Composite Material-BSTO—MgO"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766,697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO—ZnO"; U.S. Pat. No. 6,074,971 by Chiu et al. entitled "Ceramic Ferroelectric Composite Materials with Enhanced Electronic Properties BSTO—Mg Based Compound-Rare Earth Oxide". These patents are incorporated herein by reference.

Barium strontium titanate of the formula Ba.sub.xSr.sub.1-xTiO.sub.-3 is a preferred electronically tunable dielectric material due to its favorable tuning characteristics, low Curie temperatures and low microwave loss properties. In the formula Ba.sub.xSr.sub.1-xTiO.sub.3, x can be any value from 0 to 1, preferably from about 0.15 to about 0.6. More preferably, x is from 0.3 to 0.6.

Other electronically tunable dielectric materials may be used partially or entirely in place of barium strontium titanate. An example is Ba.sub.xCa.sub.1-xTiO.sub.3, where x is in a range from about 0.2 to about 0.8, preferably from about 0.4 to about 0.6. Additional electronically tunable ferroelectrics include Pb.sub.xZr.sub.1-xTiO.sub.3 (PZT) where x ranges from about 0.0 to about 1.0, Pb.sub.xZr.sub.1-xSrTiO-.sub.3 where x ranges from about 0.05 to about 0.4, KTa.sub.xNb.sub.1-xO.sub.3 where x ranges from about 0.0 to about 1.0, lead lanthanum zirconium titanate (PLZT), PbTiO.sub.3, BaCaZrTiO.sub.3, NaNO.sub.3, KNbO.sub.3, LiNbO.sub.3, LiTaO.sub.3, PbNb.sub.2O.sub.6, PbTa.sub.2O.sub.6, KSr(NbO.sub.3) and NaBa.sub.2(NbO.sub.3).sub.5KH.sub.2PO.sub.4, and mixtures and compositions thereof. Also, these materials can be combined with low loss dielectric materials, such as magnesium oxide (MgO), aluminum oxide (Al.sub.2O.sub.3), and zirconium oxide (ZrO.sub.2), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

In addition, the following U.S. patent applications, assigned to the assignee of this application, disclose additional examples of tunable dielectric materials: U.S. Pat. No. 6,514,895 filed Jun. 15, 2000, entitled "Electronically Tunable Ceramic Materials Including Tunable Dielectric and Metal Silicate Phases"; U.S. Pat. No. 6,774,077 filed Jan. 24, 2001, entitled "Electronically Tunable, Low-Loss Ceramic Materials Including a Tunable Dielectric Phase and Multiple Metal Oxide Phases"; U.S. Pat. No. 6,737,179 filed Jun. 15, 2001, entitled "Electronically Tunable Dielectric Composite Thick Films And Methods Of Making Same"; U.S. Pat. No. 6,617,062 filed Apr. 13, 2001, entitled "Strain-Relieved Tunable Dielectric Thin Films"; and U.S. Pat. No. 6,905,989 filed Jun. 1, 2001 entitled "Tunable Dielectric Compositions Including Low Loss Glass Frits". These patent applications are incorporated herein by reference.

The tunable dielectric materials can also be combined with one or more non-tunable dielectric materials. The non-tunable phase(s) may include MgO, $MgAl._2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiOb$ $\mathbf{4}_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_{3/2}SnO_2$, $Nd_2O3_3$, $Pr_7O_{11}$, Yb2O3, $Ho_2O3$, $La_2O_3$, $MgNb_2O_6$, $SrNb_2O_6$, $BaNb_2O_6$, $MgTa_2O_6$, BaTa2O6 and $Ta_2O_3$.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$. These compositions can be BSTO and one of these components or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_{3-5}H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase.

Additional metal silicates may include $Al_2Si_2O_7$, $ZrSiO_4$, $KAlSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides.

Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one preferred embodiment, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

In one embodiment, the additional metal oxide phases may include at least two Mg-containing compounds. In addition to the multiple Mg-containing compounds, the material may optionally include Mg-free compounds, for example, oxides of metals selected from Si, Ca, Zr, Ti, Al and/or rare earths. In another embodiment, the additional metal oxide phases may include a single Mg-containing compound and at least one Mg-free compound, for example, oxides of metals selected from Si, Ca, Zr, Ti, Al and/or rare earths. The high Q tunable dielectric capacitor utilizes low loss tunable substrates or films.

To construct a tunable device, the tunable dielectric material can be deposited onto a low loss substrate. In some instances, such as where thin film devices are used, a buffer layer of tunable material, having the same composition as a main tunable layer, or having a different composition can be inserted between the substrate and the main tunable layer. The low loss dielectric substrate can include magnesium oxide (MgO), aluminum oxide ($Al_2O_3$), and lanthium oxide ($LaAl_2O_3$).

When the bias voltage or bias field is changed, the dielectric constant of the voltage tunable dielectric material will change accordingly, which will result in a tunable varactor. Compared to semiconductor varactor based tunable filters, the tunable dielectric capacitor based tunable filters of this invention have the merits of lower loss, higher power-handling, and higher IP3, especially at higher frequencies (>10 GHz). It is observed that between 50 and 300 volts a nearly linear relation exists between Cp and applied Voltage.

In microwave applications the linear behavior of a dielectric varactor is very much appreciated, since it will assure very low Inter-Modulation Distortion and consequently a high IP3 (Third-order Intercept Point). Typical IP3 values for diode varactors are in the range 5 to 35 dBm, while that of a dielectric varactor is greater than 50 dBm. This will result in a much higher RF power handling capability for a dielectric varactor.

Another advantage of dielectric varactors compared to diode varactors is the power consumption. The dissipation factor for a typical diode varactor is in the order of several hundred milliwatts, while that of the dielectric varactor is about 0.1 mW.

Diode varactors show high Q only at low microwave frequencies so their application is limited to low frequencies, while dielectric varactors show good Q factors up to millimeter wave region and beyond (up to 60 GHz).

Tunable dielectric varactors can also achieve a wider range of capacitance (from 0.1 pF all the way to several .mu.F), than is possible with diode varactors. In addition, the cost of dielectric varactors is less than diode varactors, because they can be made more cheaply.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

What is claimed is:

1. A phase shifter, comprising:

a substrate;

resistive ink adjacent one surface of said substrate and separating a voltage tunable dielectric material from said surface of said substrate; and a plurality of conductors adjacent said voltage tunable dielectric material separated so as to provide a gap filled with said resistive ink in said gap.

2. The phase shifter of claim 1, further comprising a voltage source connected to at least one of said plurality of conductors and connected to said resistive ink separating said substrate and said voltage tunable dielectric material.

3. A method of manufacturing a phase shifter, comprising:

providing a substrate;

placing resistive ink adjacent one surface of said substrate and between a voltage tunable dielectric material and said substrate; and placing a plurality of conductors adjacent said voltage tunable dielectric material separated so as to provide a gap filled with said resistive ink.

4. The method of claim 3, further comprising connecting a voltage source to at least one of said plurality of conductors and to said resistive ink separating said substrate and said voltage unable dielectric material.

* * * * *